United States Patent [19]

Willis

[11] Patent Number: 4,509,606

[45] Date of Patent: Apr. 9, 1985

[54] AXIAL RETURN HAMMER

[75] Inventor: Clyde A. Willis, Wichita Falls, Tex.

[73] Assignee: Walker-Neer Manufacturing Co., Inc., Wichita Falls, Tex.

[21] Appl. No.: 552,277

[22] Filed: Nov. 16, 1983

Related U.S. Application Data

[63] Continuation-in-part of Ser. No. 201,772, Oct. 29, 1980, , which is a continuation of Ser. No. 958,886, Jan. 3, 1978, , which is a continuation of Ser. No. 854,810, Nov. 25, 1977, abandoned.

[51] Int. Cl.[3] ..... E21B 7/18

[52] U.S. Cl. ..... 175/69; 175/71; 175/215; 175/325

[58] Field of Search ..... 175/69, 60, 71, 212, 175/92, 100, 215, 230, 325, 339, 340; 173/78, 80, 73, 60

[56] References Cited

U.S. PATENT DOCUMENTS

| | | | |
|---|---|---|---|
| 3,151,690 | 10/1964 | Grable | 175/321 |
| 3,638,742 | 2/1972 | Wallace | 175/325 |
| 3,674,100 | 7/1972 | Becker | 175/69 |
| 3,978,923 | 9/1976 | Ford | 175/215 X |
| 3,991,834 | 11/1976 | Curington | 175/215 X |
| 4,057,118 | 11/1977 | Ford | 175/243 X |

*Primary Examiner*—Stephen J. Novosad
*Assistant Examiner*—Thuy M. Bui
*Attorney, Agent, or Firm*—Willian Brinks Olds Hofer Gilson & Lione Ltd.

[57] ABSTRACT

A downhole hammer drill for use with a dual concentric tube drill pipe string is characterized by the use of pressurized air from the annular passageway of the pipe string to operate the hammer. The exhaust air from the hammer is conducted to the periphery of the bit face of the hammer drill, across the bit face, and then through one or more openings in the central portion of the bit face. The exhaust air with entrained cuttings and hole water is then channeled through the drill and into the central passageway of the pipe string, through which it is removed from the drilling area. In a preferred embodiment an injection sub is provided in the drill string uphole of the drill and a drill body which substantially fills the bore annulus is used to throttle the flow of water down the borehole annulus to the bit face. In this embodiment a head of water is maintained in the borehole annulus and this water cascades down around the hammer drill to prevent cuttings and fines from moving up the bore annulus.

7 Claims, 8 Drawing Figures

AXIAL RETURN HAMMER

This application is a continuation in part of application Ser. No. 201,772, filed Oct. 29, 1980, which is a continuation of application Ser. No. 958,886, filed Jan. 3, 1978, which is a continuation of application Ser. No. 854,810, filed Nov. 25, 1977. Now abandoned.

BACKGROUND OF THE INVENTION

Hammer drilling is a well developed art with a wide variety of applications. Because it allows high penetration rates in certain rock formations, the method is widely used in applications such as well drilling, quarrying, and geological sample collecting. In conventional downhole hammer drilling a hammer drill is suspended from the downhole end of a string of single tube drill pipe. Compressed air is pumped down through the drill pipe to the drill and is there used to reciprocate a piston which delivers successive impacts to the drill bit. These impacts shatter the formation being drilled, and the exhaust air from the drill is used to carry the resulting cuttings up the annular space between the bore and the drill pipe (the bore annulus). Generally, the drill pipe and hammer drill are rotated as a unit during operation.

One significant drawback of conventional hammer drilling relates to the removal of cuttings from the drilling area. As mentioned, the upward flow of exhaust air is used to entrain the cuttings and carry them up to the bore annulus. High velocity air flow is required to efficiently transport the cuttings, and large volumes of air are necessary to maintain this high velocity flow, especially where the bore diameter is significantly larger than the drill pipe. For this reason, high capacity compressors are generally required to operate conventional hammer drills, thereby increasing the drilling cost. The presence of cuttings in the bore annulus can also lead to other problems, such as sticking of the drill in the bore, which serve to slow the penetration rate of the drill and to further increase operational costs. In order to overcome these and other disadvantages of conventional hammer drilling, repeated attempts have been made to use hammer drills with dual concentric tube drill pipe. Dual tube pipe provides two separate passageways (an annular passageway formed between the two concentric tubes, and a central passageway defined by the interior of the inner tube). Generally, compressed air is pumped down the annular passageway and cuttings are returned to the surface primarily through the central passageway.

Two attempts to use hammer drills with dual tube pipe are disclosed in U.S. Pat. No. 3,299,971, and in U.S. Pat. No. 3,871,486 and U.S. Pat. No. 3,941,196. Both of these hammer drills are designed for core cuttings; however, neither takes full advantage of the closed circulation (between the annular and central passageways) which is one of the potential advantages of dual tube drilling systems. The drill of the former patent is designed to vent exhaust air from the drill into the bore annulus, and only a part of this air circulates under the bit into the central passageway. Thus, only a part of the total available air flow is used to transport cuttings to the surface; the remainder escapes up the bore annulus, inevitably carrying with it at least some fines. The patent suggests that less air will escape up the annulus if the entire annulus is pressurized. The drill disclosed in U.S. Pat. No. 3,871,486 and U.S. Pat. No. 3,941,196 diverts a portion of the exhaust air to carry cores up the central passageway and uses the remainder to carry cuttings up the bore annulus. Because the exhaust air is not isolated from the bore annulus in either of these two drills, neither realizes the full potential reduction in air compressor capacity or in drill sticking which is possible with dual tube methods.

Similarly, the dual tube hammer drill disclosed in U.S. Pat. No. 3,991,834 also fails to isolate the exhaust air from the bore annulus. Once again, exhaust air is injected into the bore annulus, resulting in an upward flow of air and fines in the bore annulus. This upward flow results in a reduced volume of air for transporting cuttings up the inner passageway of the drill string to the surface, and it precludes the use of a hole packer to reduce the flow of liquids into the drilling area. A further disadvantage of the drill of U.S. Pat. No. 3,991,834 is that the upward flow in the hole annulus acts to agitate any fluid in the annulus, thereby reducing the viscosity of any thixotropic gel used to aid drilling. Moreover, the annulus flow results in air escaping from the annulus at the surface, a condition which may require elaborate precautions such as hoods or filtered work areas to protect the drilling crew.

The dual tube hammer drill shown in U.S. Pat. No. 3,795,283 provides a ground seal to seal the borehole annulus and a drill string and hammer body sized to fill substantially the entire borehole. No special precautions are taken to exclude fines and other cuttings from the borehole annulus and steps such as maintaining a high sheer, thixotropic, high lubricity gel may be needed to prevent fines from moving up the borehole annulus. The use of such a gel is an expensive, time-consuming approach to the sticking problem.

A second approach is proposed in U.S. Pat. No. 3,667,555 and U.S. Pat. No. 3,747,698, which utilize conventional hammer drills which are generally available in various sizes and configurations. A crossover sub is used to interconnect the drill and the dual tube pipe. This crossover sub directs compressed air from the annular passageway to the drill, and it conducts cuttings from the periphery of the drill bit to the central passageway for transport to the surface.

This approach has the drawback of requiring the use of a separate component, the crossover sub, in the drill pipe string. Furthermore, conventional drills use high velocity exhaust air to blast cuttings from the drilling area up into the bore annulus. Crossover subs attempt to redirect this high velocity flow from the annulus to the central passageway. Fine cuttings which bypass the crossover sub tend to cause sticking of the drill in the borehole.

SUMMARY OF THE INVENTION

The present invention is directed to a drilling system which comprises a hammer drill designed for use with dual tube drill pipe. Compressed air other gas is pumped down the annular passageway of the pipe into the hammer drill where it is utilized to power a hammer which delivers successive impacts to the hammer drill bit. A reciprocating piston pneumatic hammer is one example of a suitable hammer. The exhaust air from the hammer is conducted to the periphery of the hammer bit. From there the exhaust air sweeps across the face of the bit and then the air with entrained cuttings is passed up through at least one opening in the central portion of the bit face, through the drill, and into the central passageway of the drill pipe. Restricting means are provided on the drill to impede the flow of exhaust air and cuttings up into the borehole annulus. In one embodiment of the present invention this restricting means forms a portion of the external surface of the drill which is sized to a diameter smaller than but almost equal to the diameter of the borehole cut by the drill in combination with a cascade of water flowing downwardly, past the drill and across the face of the bit. Preferably, water or some other liquid is introduced into the borehole annulus to ensure that a cascade of water continuously falls from above the disclosed drill to the region of the bit face. This water then moves across the bit face and up the central passageway, along with entrained cuttings. The high speed cascade of water around the drill simultaneously accomplishes two functions: it substantially prevents the flow of air and cuttings up into the borehole annulus, and it efficiently removes cuttings from the lower face of the borehole.

The object of this restricting means is to prevent cuttings from escaping up into the annulus, thereby reducing drill sticking problems. Furthermore, by substantially confining the exhaust air to the drilling area and the central passageway, the drill of the present invention achieves high fluid velocity across the bit face and up the central passageway. As previously mentioned, this is important for efficient removal of cuttings from the drilling area.

The drilling system disclosed below advantageously incorporates means for injecting high speed jets of air upwardly into the central passageway at one or more points in the drill string uphole of the drill in order to enhance the flow of exhaust air and cuttings up through the drill. Air injection reduces the density of the column of fluids in the central passageway which permits the hammer drill of this invention to operate at greater depths than would otherwise be possible. In order to operate, hammer drills require an adequate differential in pressure between the intake pressure of the compressed gases which power the hammer and the exhaust pressure of the region into which the hammer exhausts. When drilling in water bearing formations or with drilling liquids this exhaust pressure is in large part determined by the pressure created by the column of fluid which extends from the drill to the surface. As drilling progresses to deeper regions, this column of fluids becomes longer and the exhaust pressure of the drill consequently becomes higher. Air injection reduces the density of the column of fluids and, therefore, permits drilling to a greater depth than would otherwise be possible with a given intake pressure. In addition, air injection efficiently removes the large amounts of water that reach the bit face through the cascade of water described above. Also, the upwardly directed jets of high speed air injected into the inner passageway function as a fluidic venturi which significantly lowers the pressure in such passageway below the level of such jets, thereby further reducing back pressures on the air hammer drill.

Additional objects and features of the invention will become apparent upon consideration of the following description which should be read with reference to the drawings.

DETAILED DESCRIPTION OF PREFERRED EMBODIMENTS

Figure 1:
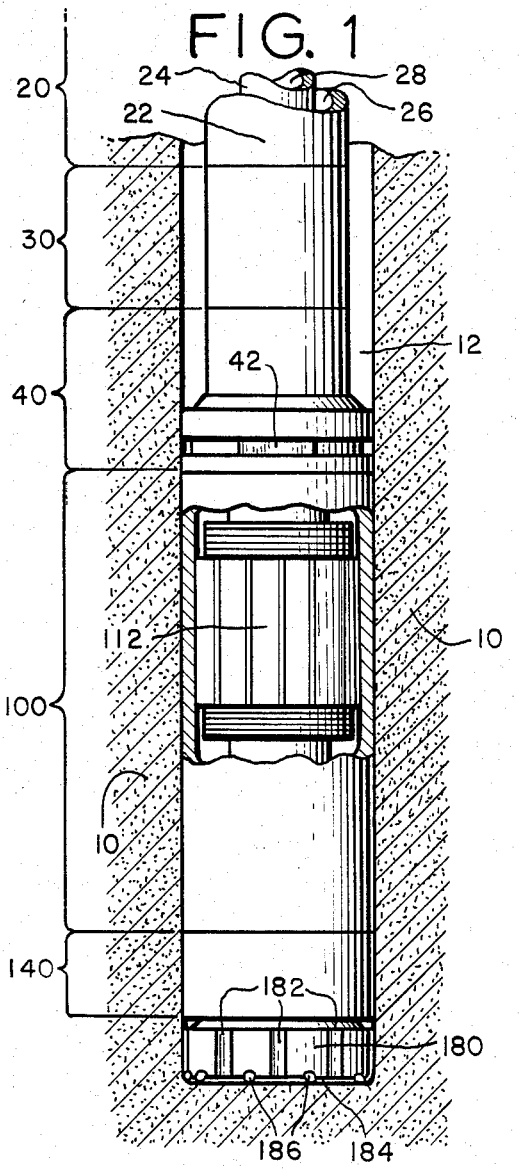
FIG. 1 is an elevational view, in partial cutaway showing a portion of a first preferred embodiment of the dual tube drilling system of the present invention.

Referring now to FIG. 1, a first embodiment of a hammer drill suitable for use in the drilling system of this invention is shown interconnected with the downhole end of a dual tube drill pipe string 20. The entire assembly is shown in place in the borehole in the rock formation 10. The pipe string 20 is of a smaller diameter than the hammer drill bit 180 and consequently an annular space, the bore annulus 12, separates the wall of the borehole from the drill pipe 20. Important elements of a dual tube drill pipe 20 include the outer tube 22 and the inner tube 24. These two elements form an annular passageway 26 and an isolated central passageway 28. An injection sub 30 is shown interconnected with the downhole end of drill pipe 20. This injection sub 30 injects upwardly a limited volume of high velocity compressed air from the annular passageway 26 into the central passageway 28, thereby aiding the flow of rock cuttings up the central passageway. The lower end of the injection sub is interconnected with the hammer drill of this invention, which comprises an upper hammer sub 40, a lower hammer sub 100, a splined hammer sub 140, and a hammer bit 180.

Broadly stated, the theory of operation of this hammer drill is that a compressed gas, which in the preferred embodiment is compressed air, is valved from the annular passageway 26 to reciprocate an annular piston 112 which delivers successive impacts to the hammer bit 180, thereby shattering the formation 10 on cutting elements 186. After the compressed air has powered the piston 112, it is exhausted as high velocity jets through circumferentially spaced bit flutes 182 to the perimeter of the bit face 184. This exhaust gas then sweeps at high velocity across the bit face 184 into bailing passages 192 which are located in the central portion of bit face 184. Cuttings are entrained by this exhaust gas flow and are carried through the bit face 184, into the bailing passages 192, and up through the center of the drill.

The following detailed description of the preferred embodiment follows the flow of compressed air down through the injector and hammer subs and generally proceeds from the uppermost components to those located lower in the borehole.

Figure 2:
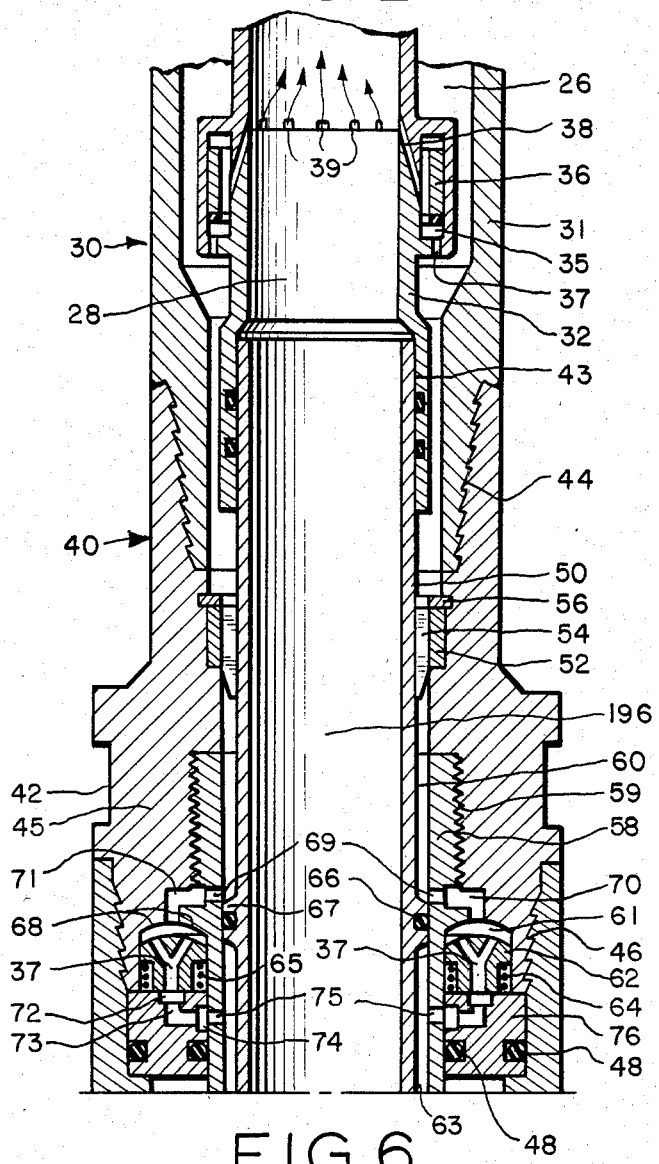
FIG. 2 is an elevational view in section of the upper portion of the system shown in FIG. 1.
Figure 5:
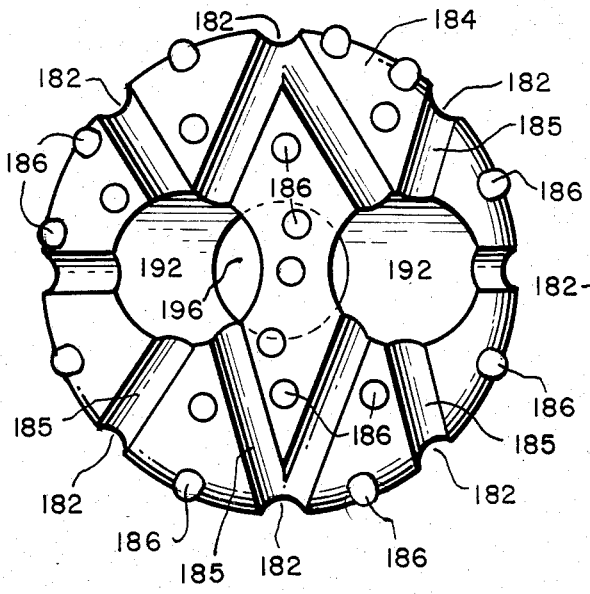
FIG. 5 is an end view taken along the line 5—5 of FIG. 3.

The uppermost component, affixed to the downhole end of the pipe string 20, is the injection sub 30. As mentioned previously, the injection sub is used to improve the removal of cuttings. As depicted in FIG. 2, the principal components of the injector sub 30 are the inner tubular member 32 and the concentric outer tubular housing 31 which define isolated central and annular passageways, 28 and 26 respectively, which are continuations of the central and annular passageways, 28 and 26, of the pipe string. When the pressure in the annular passageway 26 is sufficiently greater than the pressure in the central passageway 28, annular check valve 36 opens an array of ports 37, and compressed air is allowed to pass from the annular passageway 26 through the ports 37, the annular chamber 35, and injection apertures 38, into the central passageway 28. The injection apertures 38 open into the central passageway 28 in an array of openings 39. A suitable form of injection sub for use herein is disclosed in U.S. Pat. No. 3,978,923.

Proceeding downward, the next major element in this exemplary embodiment is the upper hammer sub 40. As in the case of the injector sub 30, the upper hammer sub 40 also comprises an outer housing 45 and a concentric inner tube 50. The interior of the inner tube 50 defines a central passageway 196 which forms a continuation of the central passageway 28 of the injector sub 30. The annular space 60 between the housing 45 and the inner tube 50 is similarly a continuation of the annular passageway 26 of the injector sub 30. The housings of the upper hammer and injector subs, 45 and 31 respectively, are interconnected by threaded connection 44. The inner tube 50 and the inner member 32 of the injector sub are interconnected by telescoping joint 43. Anchor ring 52 is attached to the inner tube 50 with circumferentially spaced spyder legs 54. The inner tube 50 is maintained in concentric alignment with the housing 45 by retaining ring 56 which captures anchor ring 52 against the housing 45.

Concentrically positioned between the inner tube 50 and the housing 45 is the manifold tube 58 which is secured at the upper end to the housing 45 by threaded connection 59 and at the lower end to the inner tube 50 by threaded connection 132. The manifold tube 58 is sized larger than the inner tube 50 so as to create upper and lower annular passageways, 60 and 63, therebetween which are a continuation of the annular passageway 26 and serve to conduct compressed air to the reciprocating piston 112. O-ring seal 124 serves to prevent leakage out of passageway 63. The flow of compressed air between annular passageways 60 and 63 is blocked by annular support shoulder 67 which is provided with an O-ring seal 66. In order to bypass this blockage, air proceeding down into the lower annular passageway 63 is forced to pass through an annular check valve 62. This check valve 62 serves to restrict the flow of fluid from the lower annular passageway into the upper annular passageway 60, while permitting flow in the reverse direction. Thus, when air pressure is lost in the upper annular passageway 60, as when the pipe string is broken at the surface in order to add a new length of pipe, ground water and other foreign material are prevented from flowing up into the hammer cylinder 102 via passages 182. In some embodiments of this invention it may be preferable to employ a plurality of conventional check valves in lieu of the annular check valve 62 described herein.

The check valve 62 is positioned in an annular valve plenum 61 which is formed between the outer housing 45 and the manifold tube 58. The manifold tube 58 is provided with an array of openings 69, and the housing 45 defines circumferential grooves 70 and 71. These openings 69 and grooves 70 and 71, combine to provide a plurality of paths through which compressed air passes from the upper annular passageway 60 to the valve plenum 61. The port annulus 76 forms the lower surface of the valve plenum 61 and is provided with circular grooves 72 and 74 and an array of connecting passages 73. Groove 74 is aligned with a lower array of openings 75 in the manifold tube 58, and air exiting from the check valve 62 is conducted from the valve plenum 61 to the lower annular passageway 63 through the array of passageways formed by grooves 72 and 74 and passages 73 and openings 75. Port annulus 76 is provided with O-ring seals 48 to reduce leakage. The check valve 62 is contained within the valve plenum 61 and is provided with an array of openings 37 through which compressed air flows when the valve is in the open position, as shown. Check valve springs 64 and 65 operate to press the check valve 62 against the valve seat 68 and thereby close the valve unless the pressure in the upper annular passageway 60 is sufficiently greater than that in the lower annular passageway 63 to compress the valve springs 64 and 65 and to move the check valve 62 to its lower position.

Figure 3:
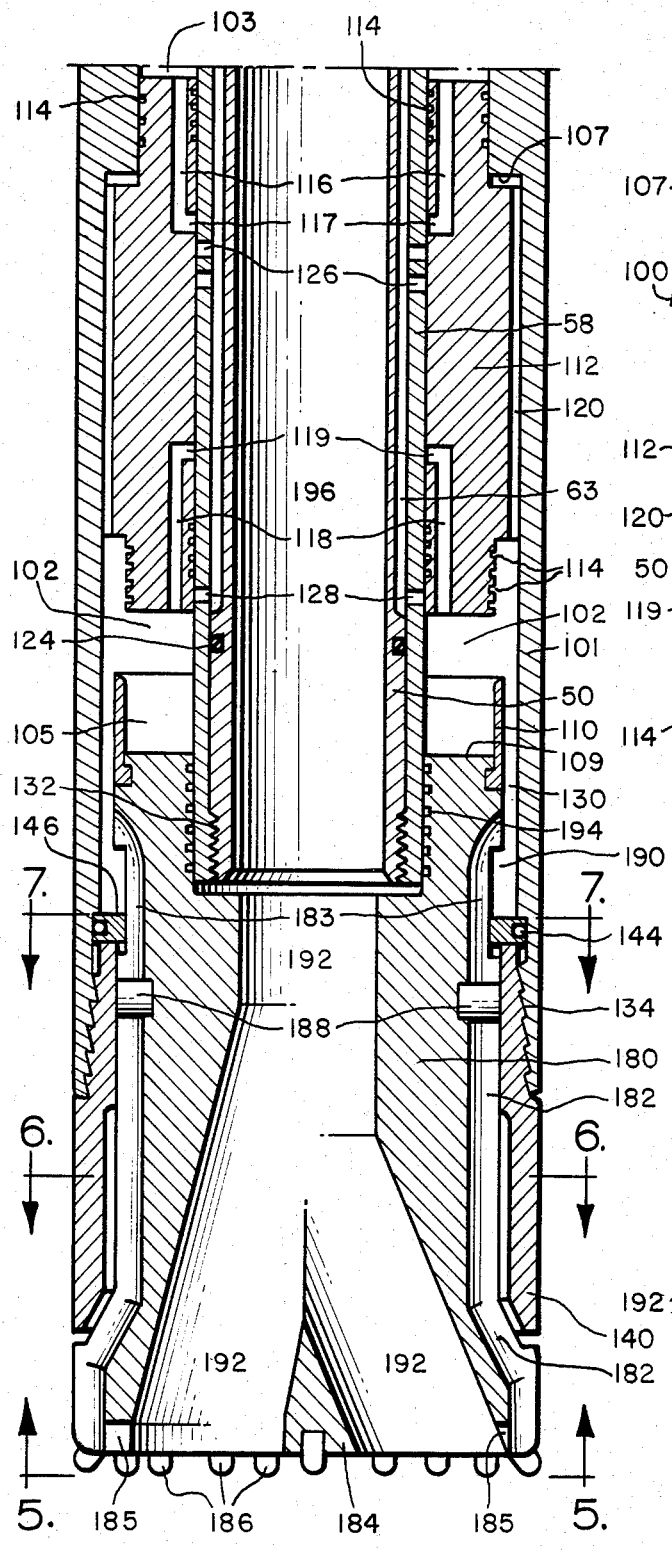
FIG. 3 is a view similar to that of FIG. 2, showing the lower portion of the system of FIG. 1 with the piston of said system in an upper position.

The port annulus 76 is held in place by the outer tubular member 101 of the lower hammer sub 100 which is connected to the housing 45 with threaded connection 46. After the air has passed through the port annulus 76 into the lower annular passageway 63, it is conducted alternately to the upper and lower compression chambers, 103 and 105, and used to reciprocate the piston 112. Valving details will be described in conjunction with FIGS. 3 and 4. FIG. 3 depicts the piston 112 in an upper position at the start of the power stroke and FIG. 4 depicts the piston 112 in a lower position at the start of the return stroke.

Referring to FIG. 3, the outer member 101 of the lower hammer sub 100 defines an annular cylinder 102 which is bounded at the top by port annulus 76, at the bottom by hammer bit 180, and at the inside by manifold tube 58. Annular piston 112 is disposed within the cylinder 102 and upper and lower compression chambers 103 and 105 are formed by circumferential shoulders 107 and 110.

The compressed air which powers the piston 112 is passed from air compressors on the surface (not shown) to the lower annular passageway 63. The manifold tube 58 forms the outer wall of this passageway 63 and is provided with circular arrays of upper intake ports 126 and lower intake ports 128. The piston 112 defines circumferential upper and lower intake grooves, 117 and 119, and upper and lower intake passages 116 and 118. The piston is also provided with a circumferential array of axial exhaust grooves 120 which serve to conduct exhaust air out of the upper compression chamber 103 and the cylinder 102. Circumferential oil grooves 114 are provided at the upper and lower ends of the piston to reduce leakage out of the compression chambers.

Figure 4:
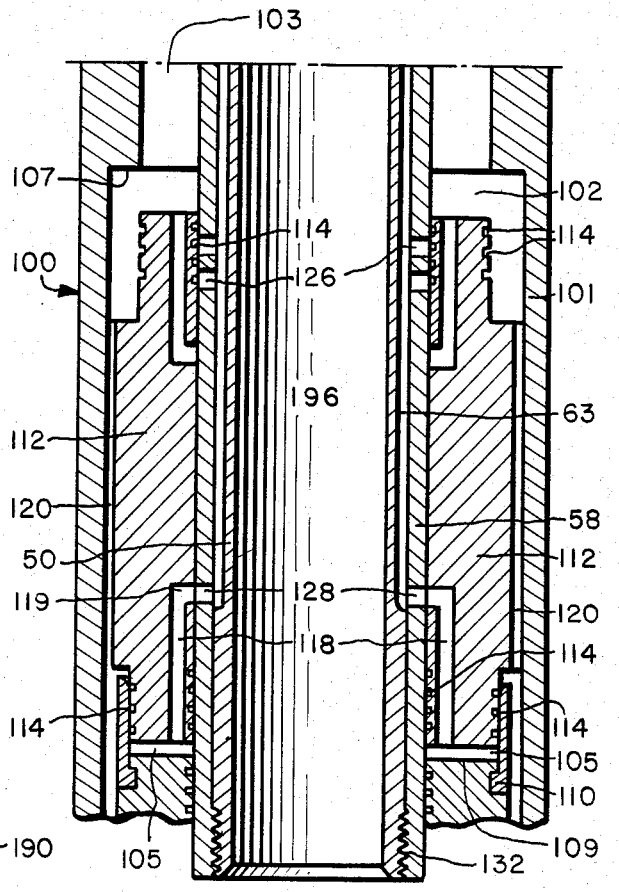
FIG. 4 is an elevational view in section of the upper part of the portion of the system depicted in FIG. 3 showing the piston in a lower position.
Figure 7:
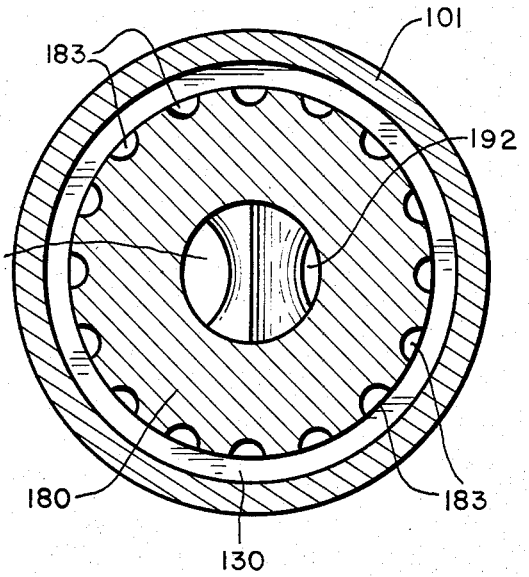
FIG. 7 is a transverse cross sectional view taken along line 7—7 of FIG. 3.

The operation of the hammer may now be described, beginning at the start of the return stroke as shown in FIG. 4. Compressed air flows from the lower annular passageway 63, through the lower ports, grooves and passages, 128, 119, 118, into the lower compression chamber 105. As the piston is raised by resulting increase in pressure the upper compression chamber is vented by exhaust grooves 120 and is, therefore, at low pressure. As the piston rises, intake port 128 is sealed and the lower compression chamber is vented when the lower end of the piston rises above the lower shoulder 110. As the piston continues to rise in the cylinder 102, the upper compression chamber 103 is formed when the upper end of the piston contacts the upper shoulder 107.

Compressed air is introduced into the upper compression chamber when the upper intake groove 117 passes the upper intake ports 126.

The power stroke begins with the piston 112 in the upper position depicted in FIG. 3. Compressed air in the upper compression chamber 103 which was introduced near the end of the return stroke causes the piston 112 to descend. Additional compressed air is added to the upper compression chamber 103 when the upper intake groove 117 passes the upper intake ports 126. The descending piston impacts on the upper face 109 of the hammer bit 180, thereby delivering the desired impact to the cutting elements 186. Immediately after this impact, the piston 112 is in the lower position depicted in FIG. 4, and the return stroke described above begins again, thereby completing the cycle.

The hammer bit 180 receives the impact of the piston 112 and transmits it to the cutting elements 186. At its upper end the hammer bit 180 fits around the lower end of the manifold tube 58, and is provided with circumferential oil grooves 194 to aid sealing between the bit 180 and the manifold tube 58. The upper outside diameter of the bit 180 is smaller than the inside diameter of the outer member 101 and the annular exhaust chamber 130 which is formed thereby provides an exit route for exhaust gas from the cylinder 102. The bit 180 is held in position in the hammer drill by retaining ring 146 which is provided with O-ring seal 144 and is captured in place when outer member 101 and splined hammer sub 140 are interconnected by threaded connection 134. Retaining ring 146 fits into retaining recess 190 of the bit 180 to limit the axial travel of the bit.

Figure 6:
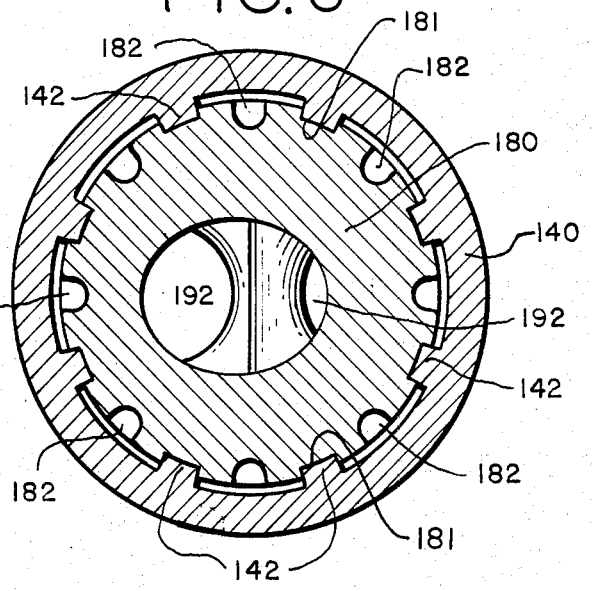
FIG. 6 is a transverse cross sectional view taken along the line 6—6 of FIG. 3.

As shown in FIG. 6, the splined hammer sub 140 is provided with internal axial splines 142 which engage mating spline grooves 181 in the bit 180 and serve to transmit pipe string rotation to the bit 180. Returning now to FIG. 3, the bit 180 defines a circumferential array of bit exhaust grooves 183 and bit flutes 182 which are interconnected by circumferential groove 188. Exhaust gas travels down from the cylinder 102 through the annular exhaust chamber 130, into the bit exhaust grooves 183 and from there on down to the periphery of the bit face 184 via groove 188 and bit flutes 182. This exhaust gas is then channeled across the bit face 184 by bit face grooves 185 which lead to the bailing passages 192. This high speed exhaust flow scours the face of the formation 10 and cuttings produced by cutting elements 186 are entrained in the flow and carried up through the bailing passages 192 into the central passageway 196 which is formed by inner tube 50. This central passageway 196 carries the exhaust gas, cuttings, and any liquid derived from the bore annulus 12 and the formation 10 up into the central passageway 28 of the dual tube drill pipe for transport to the surface.

In order to maximize the flow of exhaust gas from the bit flutes 182 into the bailing passages 192 the outer diameter of the splined hammer sub 140 is chosen to substantially fill the borehole cut by hammer bit 180. Thus, the splined hammer sub 140 serves as a flow restricting element which restricts the flow of exhaust gas and cuttings up into the bore annulus 12.

Figure 8:
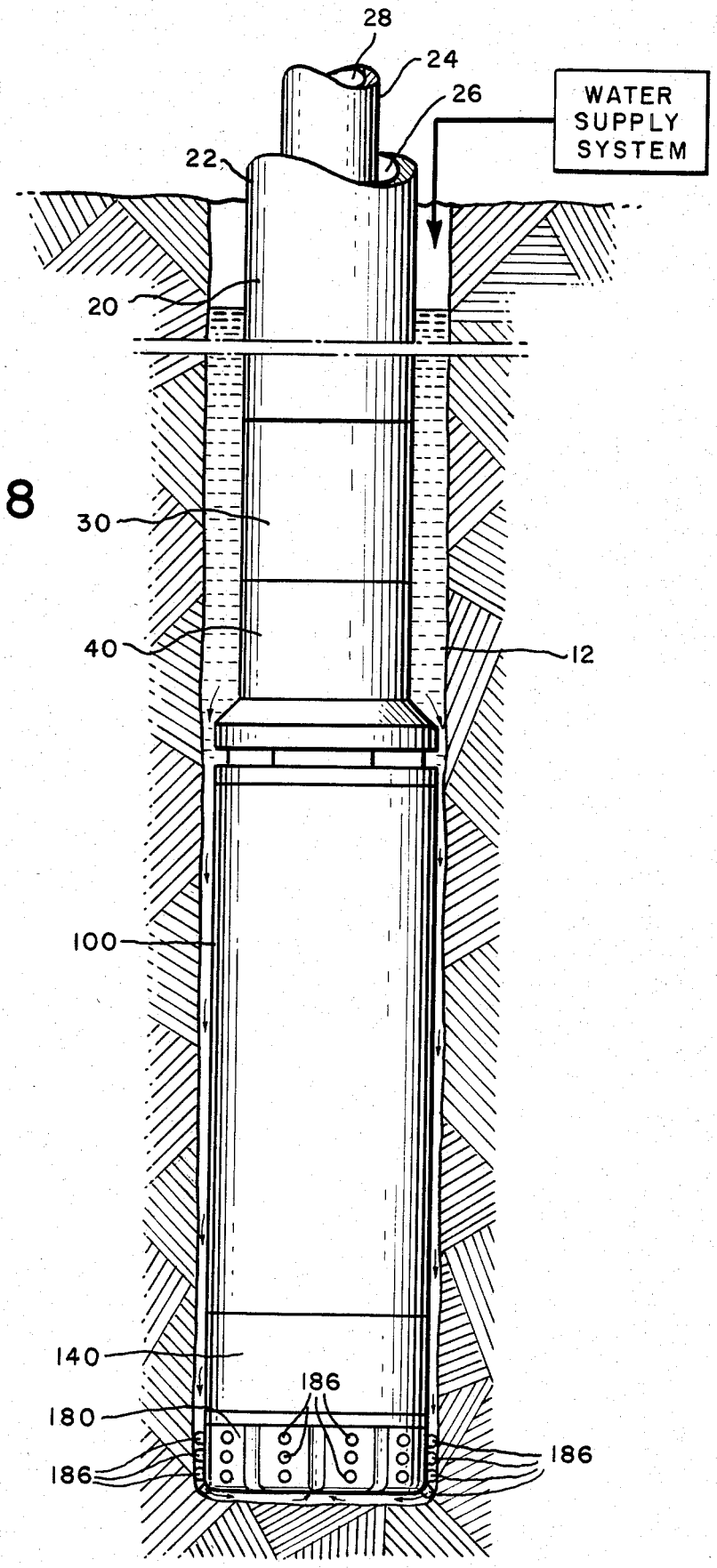
FIG. 8 is a schematic representation of a drilling system which incorporates the components of FIGS. 1–7.

FIG. 8 shows a partially schematic view of a drilling system which incorporates the components of FIGS. 1–7. The drill string 20 supports at its lower end the air injection sub 30, which in turn supports the hammer drill made up of the upper, lower and splined hammer subs 40,100,140 and the hammer bit 180. Thus, the air injection sub 30 is positioned immediately above the hammer drill. A water supply system is shown schematically in FIG. 8, and it operates to introduce water into the bore annulus 12 so as to maintain a head of water in the bore annulus above the hammer drill. The water supply system may, for example, be constructed as a holding tank or pond adjacent to the borehole. Water, if any, from formation 10 may be utilized in such system.

The cutting elements 186 on the hammer bit 180 are sized and positioned such that the diameter of the borehole is only slightly larger than the diameter of the upper, lower, and splined hammer subs 40,100,140. The annular space between the walls of the borehole and the hammer subs 100,140 should be no greater than $\frac{1}{4}$ inch, and is preferably about $\frac{1}{8}$ inch for many applications. As explained below, this tight fit between the hammer subs 100,140 and the borehole controls the rate at which water cascades downwardly across the surfaces of the hammer subs 100,140 and the bit 180 to the bottom of the borehole.

During the drilling operation the drill string 20 is rotated and compressed air is introduced into the annular passageway 26. The major portion of this compressed air operates the hammer drill and is exhausted via the periphery of the bit 180 as described above to the periphery of the lower face of the borehole, where it moves as described above to the central part of the bit and then travels, along with entrained cuttings, up the center of the hammer drill and on up to the surface via the central passageway 28. A small portion of the compressed air in the annular passageway is injected into the central passageway 28 by the air injection sub 30 to lift cuttings upwardly in the central passageway 28 and to reduce the back pressure into which the hammer drill exhausts.

During drilling operations the water supply system is used to maintain a head of water in the borehole annulus 12 above the hammer drill. When only one air injection sub 30 is used, the static head of the water in the annulus 12 is chosen to create a pressure at the hammer drill approximately equal to the air pressure in the annular passageway 26 needed to start the hammer drill, but no greater than about 80 per cent of the maximum pressure of the compressor which supplies compressed air to the drilling system. Typically, this head of water will be greater than fifty feet in height. This head of water ensures that the pressure in the borehole annulus just above the hammer will prevent the movement of air and cuttings into the borehole annulus 12.

Of course, the column of water in the borehole annulus can have a static head of substantially more than the maximum output pressure of the compressor, provided that air injection subs are placed at appropriate intervals along the drill string 12. The air injection subs will start to inject air into the central passageway in order, starting with the uppermost one in the drill string. As one injection sub provides sufficient air lift, it reduces the back pressure on the next lower one, thereby allowing it to open. When the air injector sub immediately above the hammer drill opens, the back pressure on the hammer drill is reduced enough to allow the hammer drill to begin operation.

The restricted borehole annulus around the hammer drill limits the rate at which water can pass from the borehole annulus 12 to the central passageway 28. In general, the narrower the borehole annulus around the hammer drill, the deeper the head of water in the borehole annulus 12 at which the hammer drill will operate.

In addition, the restricted borehole annulus around the hammer drill causes the water cascading down around the hammer drill to accelerate and to strike the outer perimeter of the lower face of the borehole at high velocity. This high velocity flow of water scours the perimeter of the lower face and forces cuttings inwardly as it passes inwardly across the face of the bit 180.

In effect, the water which cascades down around the hammer drill forms a continuous wall of water which simultaneously performs two important functions: it prevents cuttings and air from moving up into the borehole annulus, and it efficiently moves cuttings inwardly from the radially outer regions of the borehole face. In this second function, the moving water cooperates with the jets of exhaust air from the hammer drill which are also directed downwardly at the perimeter of the borehole face, as explained in detail above.

The height of the column of water in the borehole annulus and the clearance between the hammer drill and the wall of the borehole should be controlled to ensure that the air injection sub 30 is able to lift the water out of the vicinity of the hammer drill and to maintain a suitably low back pressure for the hammer drill. For many applications a clearance in the range of 1/16–⅛inch is suitable. The size of the clearance is controlled by selecting a bit 180 which is larger in effective diameter than the hammer subs 100,140 by the desired amount.

The head of water in the borehole annulus 12 should be kept sufficiently high to ensure that the pressure of the annulus 12 at the level of the hammer drill is greater than the back pressure caused by the upwardly moving cuttings and fluids in the central passageway by a sufficient amount to keep air and cuttings out of the borehole annulus 12. In general, deeper boreholes will require higher heads of water, and the present system is best suited for deeper drilling.

The drilling system described above differs fundamentally from prior art systems which either attempt to seal the borehole annulus to prevent the movement of fluids therein or to maintain an upward flow of air in the borehole annulus. In contrast, the system of this invention maintains a downward flow of water in the borehole annulus in order to ensure that substantially all air, cuttings and fines are prevented from moving up into the borehole annulus. In this way the formation of cementitious or clay buildups in the borehole annulus is prevented and associated sticking and loss of the hammer drill in the borehole are avoided. It has been found that elastomeric packers are subject to wear and deterioration, and that when deteriorated they allow cuttings to escape up the borehole annulus with consequent sticking problems. The present invention avoid the use of such elastomeric packers, and all such problems associated with worn packers. Instead of attempting to seal the borehole annulus, the present drilling system ensures a downward flow of water in the borehole annulus to improve cutting removal and to keep fines out of the borehole annulus.

In the present specification and claims, references to water in the borehole are to be interpreted broadly, and are meant to encompass liquid mixtures of water and other materials, such as drilling additives for example.

It should be apparent from the foregoing description that the present invention is an improved hammer drilling system which provides a wide bodied, axial flow hammer which substantially fills the borehole, thereby maximizing the available size of the cylinder and piston and, therefore, the power of the drill. This drilling system prevents essentially all cuttings, compressed air, or other fluids from traveling uphole via the bore annulus, and, therefore, reduces drill seizing and substantially eliminates the problem of dust and cuttings escaping at the surface from the bore annulus.

Of course, it should be understood that various changes and modifications to the preferred embodiment described herein will be apparent to those skilled in the art. For example, one alternate embodiment of this invention employs a hammer bit 180 which defines a single central bailing passage 192 and is used for core cutting. The annular bit face 184 shatters an annular area of the formation 10, leaving a central core which moves up into the bailing passage 192 as the drilling progresses. The bailing passage 192 is preferably curved in order to break the core into segments for transport up the central passageway and equipped with carbide inserts to reduce wear at the bend. Such changes can be made without departing from the scope of this invention and without diminishing its attendant advantages. It is intended that such changes be covered by the following claims.

I claim:

1. A method for drilling a borehole comprising the following steps:

providing a concentric dual tube pipe string which defines a central passageway and an annular passageway;

providing an air driven hammer drill at a lower end of the pipe string, said hammer drill comprising:

a hammer bit which defines a bit face;

means for receiving pressurized air from the annular passageway;

hammer means operated by the pressurized air for delivering successive impacts to the bit;

conducting means for directing exhaust air from the hammer means to the periphery of the bit face; and channeling means for passing substantially all of the exhaust air and entrained cuttings from the periphery of the bit face, across the bit face and through at least one passage extending between a central portion of the bit face and the central passageway;

said hammer drill defining a wide bodied portion which substantially fills the borehole formed by the bit;

providing an air injection sub in the pipe string near the hammer drill to inject compressed air from the annular passageway into the central passageway;

operating the hammer drill to form a borehole; and maintaining a head of water in the borehole annulus above the hammer drill during operation of the hammer drill to cause water to cascade down continuously around the hammer drill to the region of the bit face and to sweep across the bit face into the passage and on into the central passageway;

said wide bodied portion of the hammer drill operating to restrict, direct and accelerate the flow of water to the region of the bit face;

said flow of water cooperating with the flow of exhaust air to prevent the movement of cuttings and exhaust air into the borehole annulus;

said air injection sub operating to lift water and cuttings up the central passageway.

2. The method of claim 1 wherein none of the passages occupies the center of the bit face.

3. The method of claim 1 wherein the wide bodied portion defines a diameter that is no more than approximately 96% of the diameter of the borehole formed by the hammer bit.

4. The method of claim 1 wherein the conducting means comprises an array of conduits formed around the perimeter of the bit.

5. The method of claim 1 wherein the channeling means comprises an array of channels in the bit face extending between the periphery of the bit face and the at least one passage.

6. The method of claim 1 wherein the head of water is maintained at a height of no less than fifty feet.

7. The invention of claim 1 wherein the maintaining step includes the step of introducing water into the borehole around the pipe string.

* * * * *